United States Patent [19]

Schulze-Berge et al.

[11] Patent Number: 4,480,441

[45] Date of Patent: Nov. 6, 1984

[54] ICE MAKER HARVEST CONTROL

[75] Inventors: Carl J. Schulze-Berge; Vance L. Kohl, both of Manitowoc, Wis.

[73] Assignee: The Manitowoc Company, Inc., Manitowoc, Wis.

[21] Appl. No.: 461,122

[22] Filed: Jan. 26, 1983

[51] Int. Cl.[3] ..... F25C 1/12

[52] U.S. Cl. ..... 62/138; 73/304 R

[58] Field of Search ..... 62/138; 137/392; 73/304 R

[56] References Cited

U.S. PATENT DOCUMENTS

| | | | |
|---|---|---|---|
| 2,959,026 | 11/1960 | Swanson | 62/138 |
| 2,982,113 | 5/1961 | Pichler | 62/138 X |
| 3,339,578 | 9/1967 | Smith | 137/392 |
| 3,340,892 | 9/1967 | Holland | 137/392 |
| 3,430,452 | 3/1969 | Dedricks et al. | 62/138 |
| 3,918,267 | 11/1975 | Canter | 62/138 |
| 4,065,227 | 12/1977 | Rose | 137/392 X |

*Primary Examiner*—William E. Tapolcai

*Attorney, Agent, or Firm*—Leydig, Voit, Osann, Mayer & Holt, Ltd.

[57] ABSTRACT

A vertical ice cube mold chilled by a refrigeration system has a water stream pumped into its open vertical face to build up ice cubes in the mold. A probe hangs over the open mold face at an adjustable spacing. When the mold fills with ice and the water stream contacts the probe, an electrical circuit is completed to cause a control to stop the water pump and heat the mold, thus harvesting the ice cubes. A timer restarts the icemaking cycle in case ice is not delivered for some reason. Casual water contact with the probe is prevented from tripping the control through the use of a simple integrator device.

4 Claims, 4 Drawing Figures

ICE MAKER HARVEST CONTROL

This invention relates generally to ice making machines of the larger commercial variety and more specifically concerns a control system for initiating the harvest cycle in such machines.

Commercial ice making machines typically direct water into a mold that is in close thermal contact with the evaporator coil portion of a refrigeration system. When ice has been formed, the machine is placed in a harvest cycle in which water delivery is stopped and hot gas from the refrigeration system is fed into the evaporator coils so as to heat the mold and dislodge the ice for collection and storage.

A common way of initiating a harvest cycle is to sense gas pressure in the refrigeration system. As the ice builds up in the mold, less heat will be absorbed by the circulating gas, resulting in a pressure change. A gas pressure switch can therefore be set to initiate a harvest cycle when the pressure level reaches what is found when the ice mold is full.

This indirect sensing of the completion of an ice making cycle has practical problems. A gas pressure switch is somewhat expensive, and it also presents service problems to the primarily mechanically inclined persons who are charged with keeping such machines operating properly. More important, gas pressure is a function of temperature, and therefore the ambient temperature of the region in which a machine is placed affects operation of a pressure switch. It is difficult for someone installing or servicing machines located both in hot kitchens and cool motel corridors to reach the proper setting for a gas pressure harvesting switch.

Accordingly, it is the primary aim of the invention to provide a harvest control for an ice making machine that directly senses the desired extent of ice buildup so as to be completely temperature independent. A collateral object of the invention is to provide such a control that not only can be factory set but which can be, if necessary, easily adjusted for permitting fine variations in ice buildup by reasonably competent service personnel.

Another object is to provide a control as characterized above that is made up of simple mechanical-electrical components so as to be inexpensive to manufacture, reliable in operation, and easy to service and maintain.

Other objects and advantages of the invention will become apparent upon reading the following detailed description and upon reference to the drawings, in which.

Figure 1:
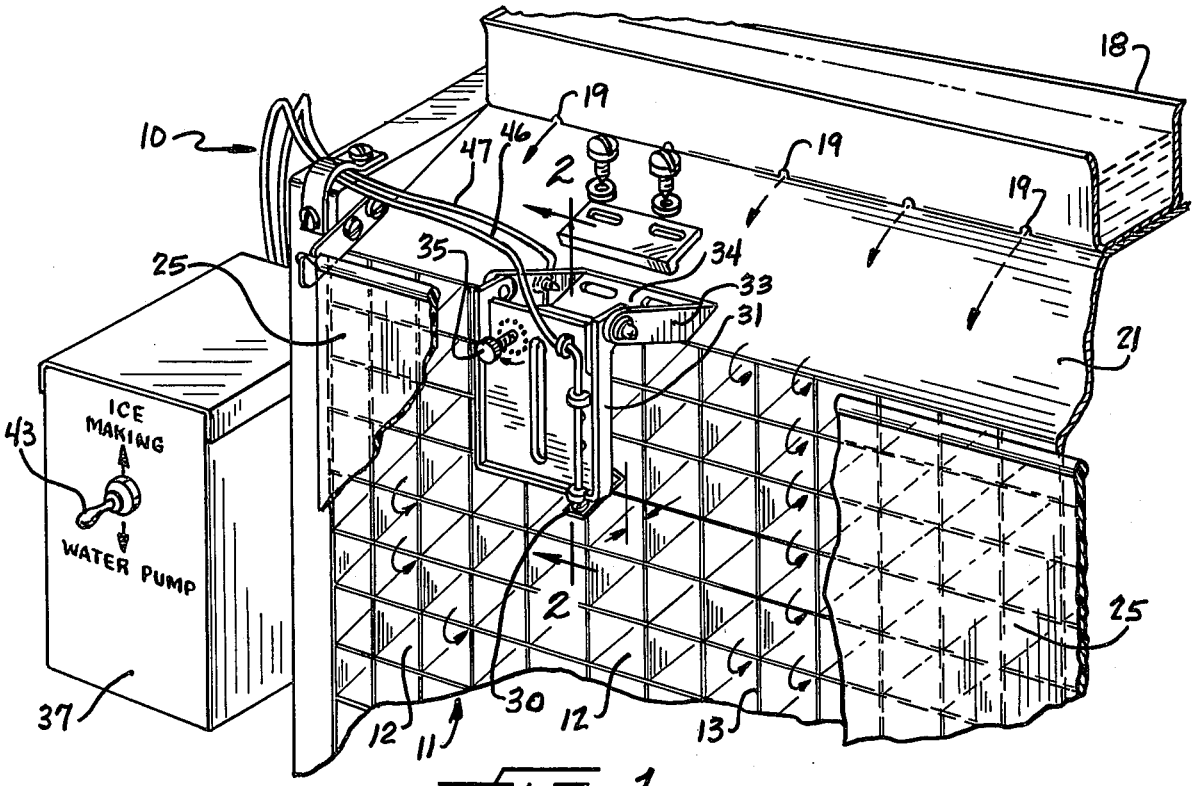
FIG. 1 is a fragmentary perspective of a portion of an ice making machine embodying the invention.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Turning to the drawings, there is shown portions of an ice making machine 10 including a freezing mold 11 with cells 12 for forming ice cubes and having an open face 13. A refrigeration system including evaporator coils 14, a compressor 15, and a cooling fan powered by a motor 16 is adapted to chill the mold 11 in the usual fashion. A water pump 17 delivers water to a fountain trough 18, from which a stream of water flows through holes 19 in the trough 18, over a water dispersing skirt 21, and into the mold 11.

Figure 2:
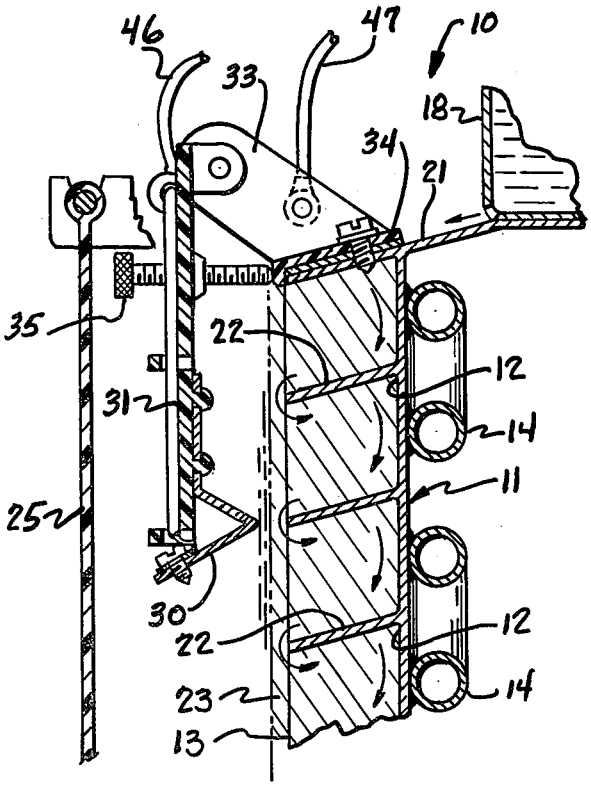
FIG. 2 is an enlarged fragmentary section taken approximately along the line 2—2 in FIG. 1.
Figure 3:
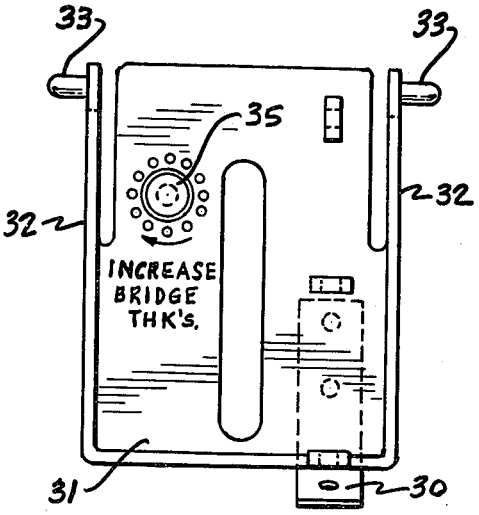
FIG. 3 is an elevation of the ice sensing probe and support shown in FIG. 2.

In the illustrated machine, the mold is substantially vertical, but its horizontal surfaces 22 slope down toward the open face 13. As disclosed in U.S. Pat. No. 3,430,452, issued Mar. 4, 1969, water flows as indicated by the arrows in FIGS. 1 and 2, gradually building up ice cubes in the cells. When ice has filled the cells 12, the water stream freezes over the open face 13 of the mold to build up an ice bridge 23 connecting all of the individual cubes. During this ice making cycle, the mold open face 13 is shielded to contain splashing water by an ice curtain 25 freely pivoted at its top.

At the end of the ice making cycle, an ice harvesting cycle results from stopping the water pump 17 and energizing a hot gas solenoid 26 which directs hot gas in the refrigeration system to the coils 14. Preferably, the fan motor 16 is also stopped to minimize cooling of this gas. As the mold 11 heats, a film of water is melted from the surface of the cubes in contact with a mold, and the thus released ice slides down the sloping horizontal surfaces 22 as a single mass, the cubes being connected by the ice bridge 23. The ice falls down into a storage bin (not shown) moving past, and swinging out, the water curtain 25. The shock of falling into the bin and/or slight subsequent evaporation separates the ice into individual cubes.

In accordance with the invention, an ice harvest sensor, which directly senses the completion of the ice making cycle, includes an electrically conducting probe 30 slightly spaced from the mold open face 13 mounted on a non-electrically conducting support 31 that can adjust the probe spacing as well as move completely clear when ice is harvested. Preferably, the probe 30 is a simple strip of metal, and the support 31 is a plastic panel having flexible arms 32 with shaft lugs 33 that are snapped into holes formed in the arms of an electrically conducting bracket 34 mounted on the top of the mold 11 so that the support 31 swings freely. A simple thumb screw 35 is threaded in the support 31 to bear on the mold 11 so as to adjust the spacing of the probe 30 from the open face 13 of the mold.

Figure 4:
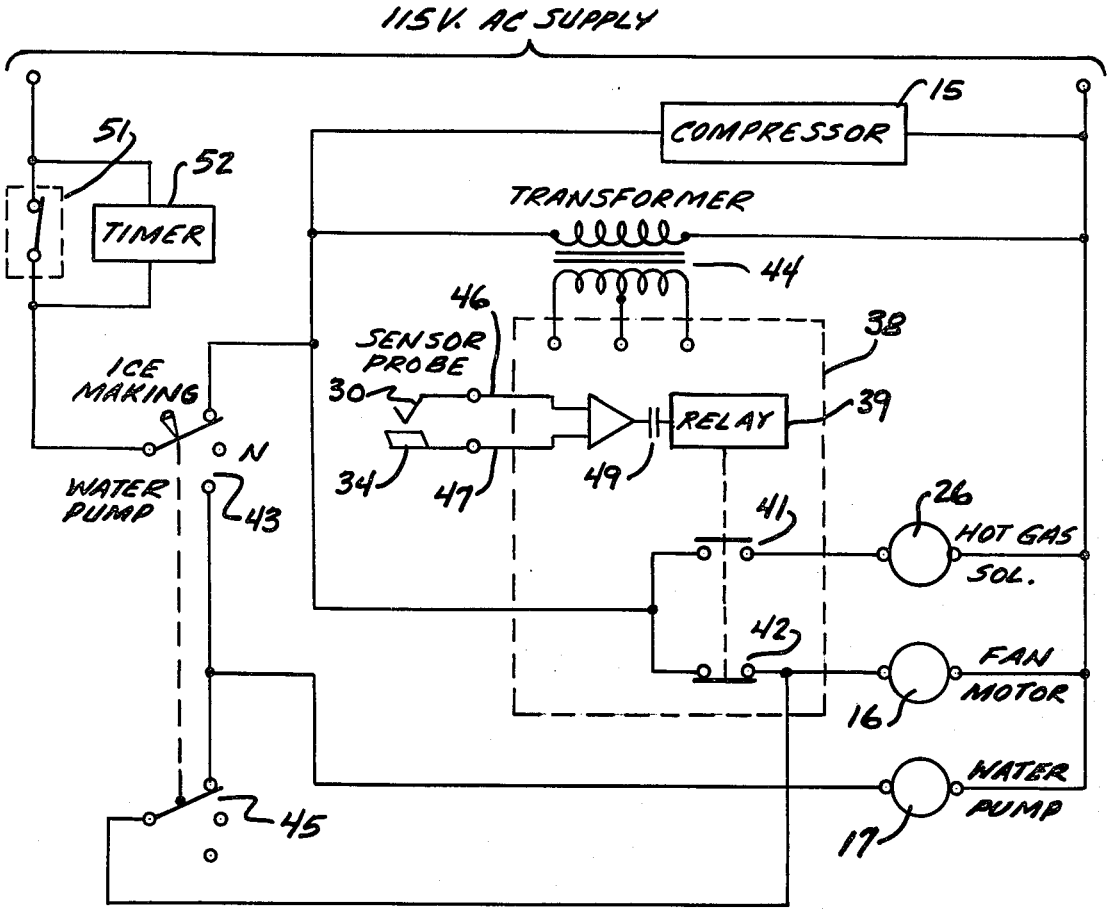
FIG. 4 is a wiring diagram for portions of the machine of FIG. 1.

The control for the machine 10 is enclosed in a housing 37 and includes a circuit card 38 having a relay 39 with contacts 41 and 42. A mode switch 43, when in ice making position, energizes the compressor 15 of the refrigeration system, the card 38 through a step down transformer 44, the fan motor 16 through relay contacts 42, and the water pump 17 through relay contacts 42 and a second bank of contacts 45 on the switch 43. For service cleaning purposes, the mode switch 33 can be placed in an alternate water pump position and it can be seen in FIG. 4 that this opens the contacts 45 so that only the pump 17 will be energized.

The sensor probe 30 is connected to the control through one conductor 46 directly attached, and a second conductor 47 attached to the bracket 34. When the mold 11 is filled with ice and the bridge 23 formed and thickened, the water stream flowing across the face of the ice bridge 23 eventually contacts the probe 30, thereby completing a circuit, kept at low voltage by the transformer 44, that picks up the relay 39 to energize the hot gas solenoid 26 through contacts 41 and de-energize the fan motor 16 and the water pump 17 by opening contacts 42.

To prevent intermittent water splashes closing the circuit through the probe 30 from tripping the relay 39, an integrator device 49 is put in the circuit so that the relay 39 is not tripped until the probe circuit remains closed for a short continuous period.

As mentioned above, the harvested ice swings out the water curtain 25 as it falls into the storage bin. That movement of the curtain 25 opens a bin switch 51 which de-activates the entire control circuit and thus drops out the relay 39 to its initial position. When the curtain 25 swings back and the bin switch 51 closes, a new ice making cycle is started. A feature of the invention is providing a timer switch 52 paralleling the bin switch 51. If for any reason a harvest cycle is initiated and no ice falls to trip the bin switch 51, the machine would stay off absent some other actuation. The timer switch 52 is set to time starting with the initiation of each ice harvest cycle and to run for a period of perhaps twice the length of a typical harvest cycle. The timer switch 52 then closes to start an ice making cycle if such a cycle has not already been initiated by the bin switch 51.

It can thus be seen that an ice harvest initiating control has been provided that directly senses the desired completion of an ice making cycle. It can also be seen that the control is completely independent of ambient temperature.

The positioning or adjustment of the sensor probe 30 is easily accomplished and can be readily visualized by anyone servicing the machine.

Those skilled in the art will appreciate that the mechanical and electrical components making up the control are relatively simple with the result that manufacturing costs are minimized, and reliability in operation and ease of servicing can be expected.

We claim as our invention:

1. In an ice making machine having a freezing mold with cells and an open face, a pump for delivering a water stream into said mold, a refrigeration system for chilling said mold, and an electrical control for stopping said pump and causing said refrigeration system to heat rather than chill said mold, an ice harvest sensor comprising, in combination, an electrically conducting probe mounted on a non-electrically conducting support with the probe being slightly spaced from said mold open face and being free to move well clear of the mold face, means for adjusting the spacing of said probe from said open face, means for electrically coupling said control with the water stream delivered into said mold, and means for coupling said control with said probe so that contact between the probe and the water stream delivered into the mold completes a circuit causing said control to stop said pump and heat the mold so as to harvest ice.

2. The combination of claim 1 in which said mold is formed with a plurality of cells for making ice cubes and is substantially vertical so that said open face is vertical, said support is a plastic panel pivoted at the top so as to swing said probe toward and away from said open face, and said means for adjusting is a thumb screw threaded in said panel and bearing on said mold.

3. The combination of claim 1 in which said control includes an integrating device in said circuit so that only constant, not brief intermittent, contact between the probe and the water stream causes the contact to stop the pump and heat the mold.

4. The combination of claim 1 including a switch actuated by delivery of ice from said mold for resetting said control so that said pump is operated and said mold is chilled, and a timer switch connected in parallel to said switch for resetting said control at a fixed time exceeding that normally needed for an ice harvest cycle so that the ice making cycle is restarted even if the ice delivery switch is not activated.

* * * * *